US012342908B2

(12) United States Patent
Fujima et al.

(10) Patent No.: US 12,342,908 B2
(45) Date of Patent: Jul. 1, 2025

(54) FASTENING DEVICE FOR AIR CYLINDER

(71) Applicant: TABATA CO., LTD., Tokyo (JP)

(72) Inventors: Taro Fujima, Tokyo (JP); Yuji Kuroda, Tokyo (JP); Samu Mochizuki, Tokyo (JP)

(73) Assignee: TABATA CO., LTD., Tokyo (JP)

( * ) Notice: Subject to any disclaimer, the term of this patent is extended or adjusted under 35 U.S.C. 154(b) by 0 days.

(21) Appl. No.: 18/494,770

(22) Filed: Oct. 26, 2023

(65) Prior Publication Data

US 2024/0138527 A1 May 2, 2024

(30) Foreign Application Priority Data

Oct. 31, 2022 (JP) ..... 2022-174952

(51) Int. Cl.
*A44B 11/06* (2006.01)
*B63C 11/30* (2006.01)

(52) U.S. Cl.
CPC ..... *A44B 11/06* (2013.01); *B63C 11/30* (2013.01); *B63C 2011/303* (2013.01)

(58) Field of Classification Search
CPC ... A44B 11/06; A44B 11/125; Y10T 24/2102; Y10T 24/2132; Y10T 24/2143; Y10T 24/2164; Y10T 24/2147; Y10T 24/4086; B63C 11/22; B63C 2011/303; B63C 2011/22281; B63C 2011/026; B63C 11/30
See application file for complete search history.

(56) References Cited

U.S. PATENT DOCUMENTS 4,073,317 A * 2/1978 Ellis ..... F16L 3/137 24/270
4,564,981 A * 1/1986 Knox ..... A44B 11/125 410/23
4,567,628 A * 2/1986 Prete, Jr. ..... A44B 11/14 24/68 CD
4,777,703 A * 10/1988 Knox ..... A44B 11/25 24/193
4,796,336 A * 1/1989 Scully ..... A44B 11/125 24/68 CD
4,918,790 A * 4/1990 Cirket ..... A44B 11/006 24/71 R
10,772,389 B2 * 9/2020 Rossi ..... A44B 11/125
11,470,920 B2 * 10/2022 Tucker ..... B60P 7/0823
2003/0028215 A1 * 2/2003 Brooks ..... A61B 17/1327 606/203
2006/0032028 A1 * 2/2006 Takeuchi ..... B63C 11/22 24/197

FOREIGN PATENT DOCUMENTS

JP 2006-051890 A 2/2006

* cited by examiner

*Primary Examiner* — Jason W San
*Assistant Examiner* — Rowland Do
(74) *Attorney, Agent, or Firm* — HAUPTMAN HAM, LLP

(57) ABSTRACT

The fastening device for the air cylinder includes a belt having a first end portion and a second end portion, a coupling ring attached to the first end portion of the belt, and a buckle to which the second end portion of the belt is attached. The buckle includes locking grooves in which locking portions of the coupling ring are releasably locked. The locking grooves include openings that gradually widen toward a rear face side. The front face of the buckle includes bent portions that are brought into contact with an outer circumferential face of the air cylinder when coupling between the belt and the coupling ring is released.

3 Claims, 16 Drawing Sheets

FASTENING DEVICE FOR AIR CYLINDER

RELATED APPLICATIONS

The present application claims priority to Japanese Application Number 2022-174952, filed Oct. 31, 2022, the disclosure of which applications are hereby incorporated by reference herein in their entirety.

BACKGROUND OF THE INVENTION

The present invention relates to a fastening device for fastening an air cylinder (bombe) containing air and used by a diver or the like to a harness.

There have been well-known fastening devices for fastening an air cylinder to a harness. For example, Japanese Unexamined Patent Application Publication No. 2006-51890 discloses a fastening device including a belt for releasably fastening an air cylinder to a harness and a buckle as a fastening means for the belt.

SUMMARY OF THE INVENTION

According to a fastening device disclosed in Japanese Unexamined Patent Application Publication No. 2006-51890, part of a belt is inserted through a belt insertion portion in a buckle and fastened until a sufficient tightened state is achieved, where temporary fastening is completed. This enables easy length adjustment of the belt.

With such a fastening device, in order to release fastening by the buckle, a user needs to lift the buckle so as to separate the buckle from the air cylinder. The user needs to pull up and lift not only the air cylinder, but also a buoyancy compensator jacket containing a lot of water after diving, which is troublesome.

Furthermore, there has been a well-known fastening device for an air cylinder including a metal ring attached to one end of a belt and a metal lock member that is attached to the other end and to which the ring is locked. With such a fastening device, fastening of the fastening device is performed with the length of the belt having been adjusted, and thus temporary fastening cannot be performed. Therefore, a fastening degree of the belt is not easily grasped. In addition, in order to release the fastening of the metal fastening device, the user needs to work with both hands.

An object of the present invention is to provide a fastening device for an air cylinder capable of easy belt adjustment and fastening release by a single operation.

The present invention relates to the fastening device for the air cylinder.

According to the fastening device for the air cylinder of the present invention, the fastening device includes a belt including first and second end portions, a coupling ring attached to the first end portion of the belt, and a buckle to which the second end portion of the belt is attached. The buckle includes a front face and a rear face, a distal end edge, base end edges, base end portions, and locking grooves that are disposed in the base end portions and in which locking portions of the coupling ring are releasably locked. The locking grooves include openings that gradually widen toward a rear face side. The front face of the buckle includes bent portions that are brought into contact with an outer circumferential face of the air cylinder when coupling between the belt and the coupling ring is released.

The fastening device for the air cylinder according to the present invention includes the following preferred aspects.

(1) An inner circumferential face of each of the locking grooves includes an inclined wall face disposed on a distal end side of the buckle and a first wall face extending from the inclined wall face toward a front face side. An angle $\alpha$ between the first wall face and a virtual line of tensile force extending from a center point of each of the locking portions of the coupling ring is 90 degrees or less.

(2) The inner circumferential face of the locking groove further includes a second wall face disposed on a base end side and a bottom wall connecting the first wall face and the second wall face. A corner is disposed between the inclined wall face and the first wall face. A spacing dimension between the bottom wall and the corner is larger than a radius of the locking portion.

(3) The bent portions are disposed near a center portion of a longitudinal dimension of the buckle.

With the fastening device for the air cylinder according to the present invention, a belt length can be easily adjusted when the buckle is raised on the air cylinder, and coupling between the coupling ring and the buckle can be released by a single operation when a user holds a distal end portion and further rotates the buckle from the raised state.

BRIEF DESCRIPTION OF DRAWINGS

The drawings illustrate specific embodiments of the present invention including optional and preferred embodiments as well as essential features of the invention.

FIG. 3(*b*) is a perspective view of a coupling ring.

FIG. 4(*b*) is a rear view of the buckle.

FIG. 5(*b*) is a perspective view of the buckle as seen from a distal end edge side.

DESCRIPTION OF EMBODIMENTS

Figure 1:
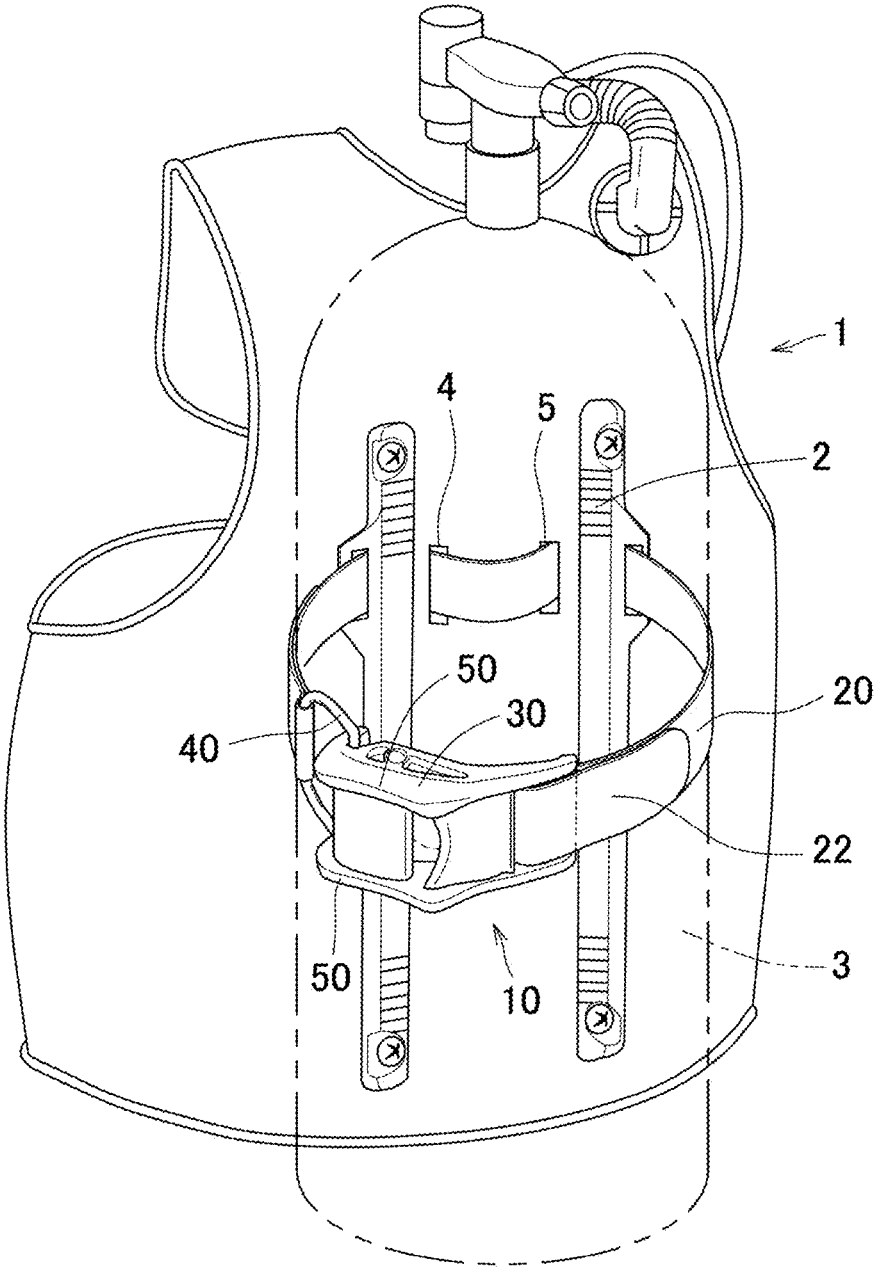
FIG. 1 is a diagram showing a use state of a fastening device according to a first embodiment.
Figure 2:
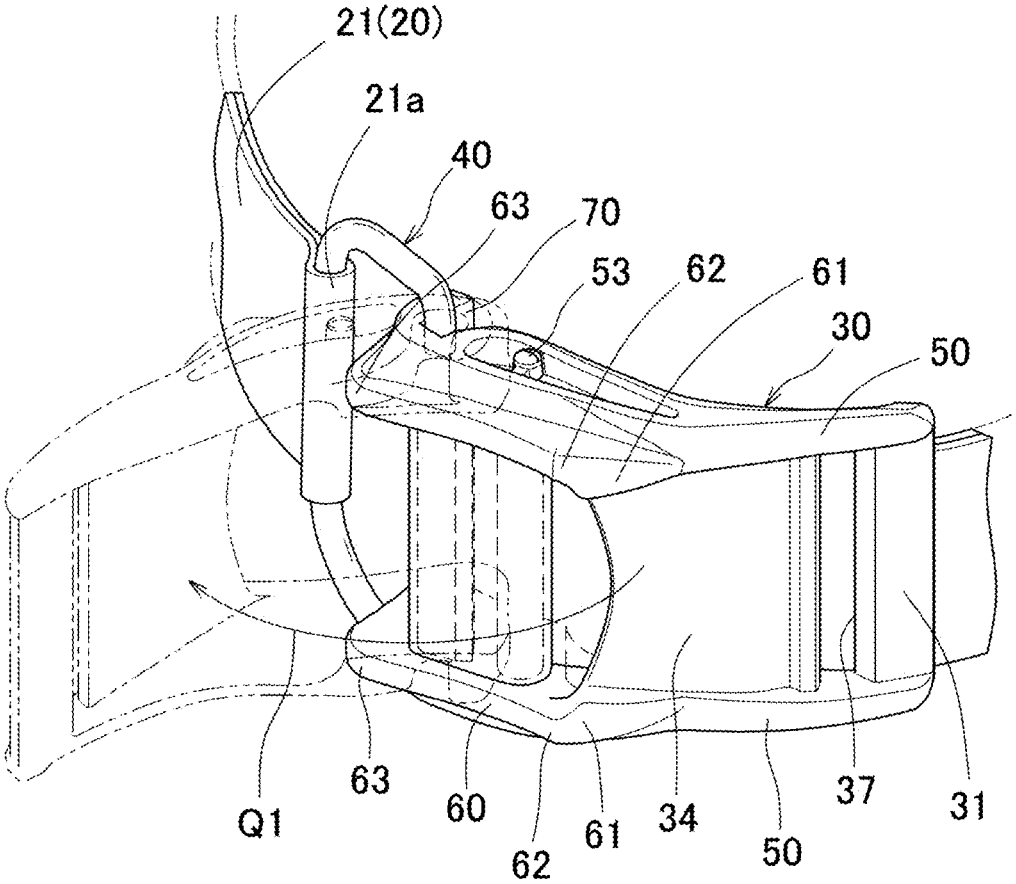
FIG. 2 is an enlarged view of the fastening device in the use state.

Referring to FIG. 1 and FIG. 2, a fastening device 10 according to the present invention is used for fastening a cylindrical air cylinder (air bombe or cylinder) 3 to a harness 2 integrated with a buoyancy compensator jacket 1 worn by a diver. The jacket 1 includes hose for supplying air from the air cylinder 3, a pressure reducing valve attached to the air cylinder 3, or the like. The air cylinder 3 is detachably fastened to the jacket 1 or the like by the fastening device 10.

The fastening device 10 includes a belt 20, a coupling ring 40 attached to an attaching portion 21*a* in a loop shape at a first end portion 21 of the belt 20, and a buckle 30. The air cylinder 3 can be stably fastened to the harness 2 by tightening the belt 20 wound around the air cylinder 3.

In such a use state, the belt 20 is wound around the air cylinder 3 while being inserted through insertion holes 4 and 5 formed in the jacket 1 and the harness 2, and the buckle 30 is laid down. When a user (diver or the like) holds the buckle 30 and rotates the buckle 30 in a direction of an arrow Q1, the state of the belt 20 shifts from a tightened state to a loosened state. When the user further rotates the buckle 30 in the direction of the arrow Q1 to invert the buckle 30, fastening of the fastening device 10 is released. The fastening device 10 may be used as a device for fastening an air cylinder for another usage, as well as the air cylinder 3 mounted on the buoyancy compensator jacket 1.

Figure 3A:
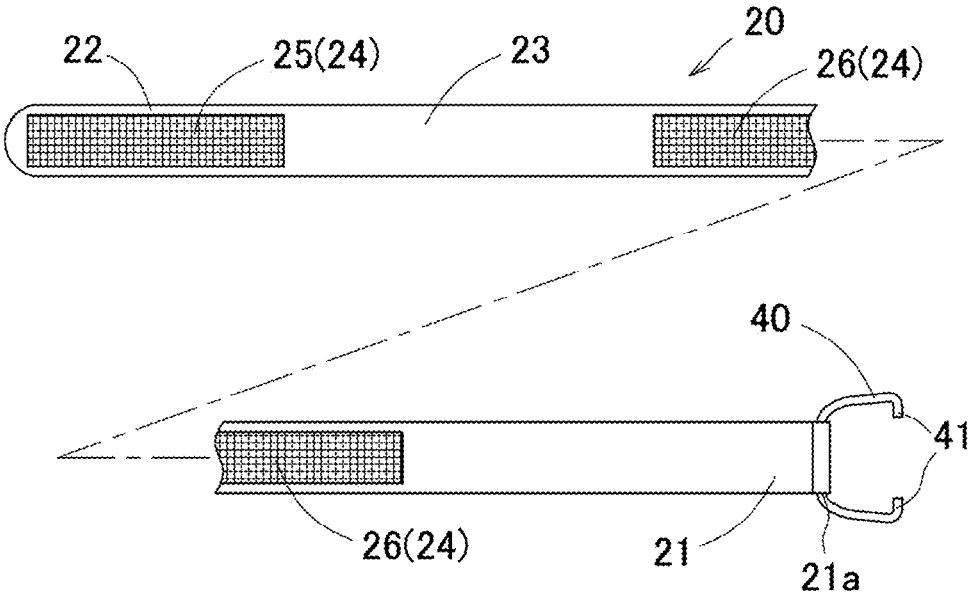
FIG. 3(*a*) is a plan view of a belt.
Figure 3B:
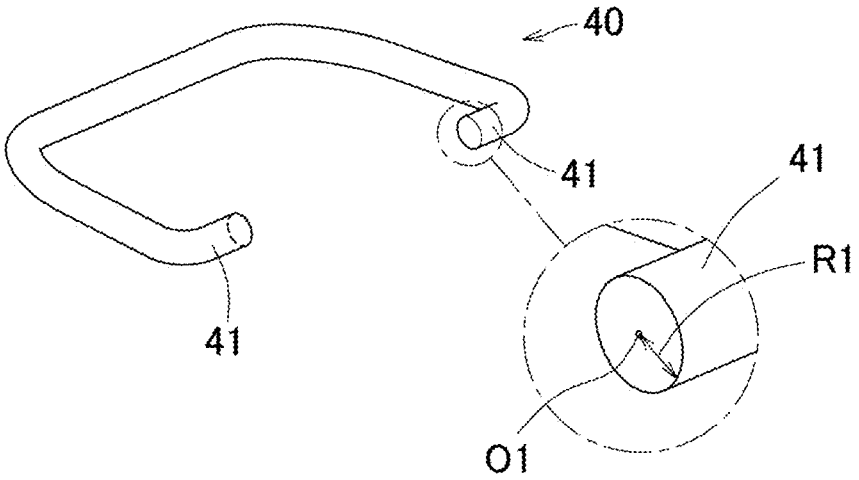

Referring to FIG. 3(*a*), the belt 20 includes first and second end portions 21 and 22 opposed to each other in a length direction, and an intermediate portion 23 between the first and second end portions 21 and 22. The belt 20 includes a fastening means 24 for fastening portions of the belt that overlap each other when the belt 20 is wound around the air cylinder 3. The fastening means 24 includes a hook portion 25 made of hook elements of a mechanical fastener on a second end portion 22 side and a target portion 26 made of loop elements of the mechanical fastener on an outer face side of the intermediate portion 23.

Referring to FIG. 3(*b*), the coupling ring 40 is a C-ring made of a round bar and having locking portions 41. A cross-sectional shape of each of the locking portions 41 is a circle with a radius R1. The buckle 30 and the coupling ring 40 can be formed of various well-known materials such as metal, rubber, or rigid or flexible plastic. The coupling ring 40 is preferably made of metal in order to stably fasten the air cylinder 3 via the belt 20, whereas the buckle 30 is preferably made of plastic in order to reduce the weight of the fastening device 10 as a whole.

Figure 4A:
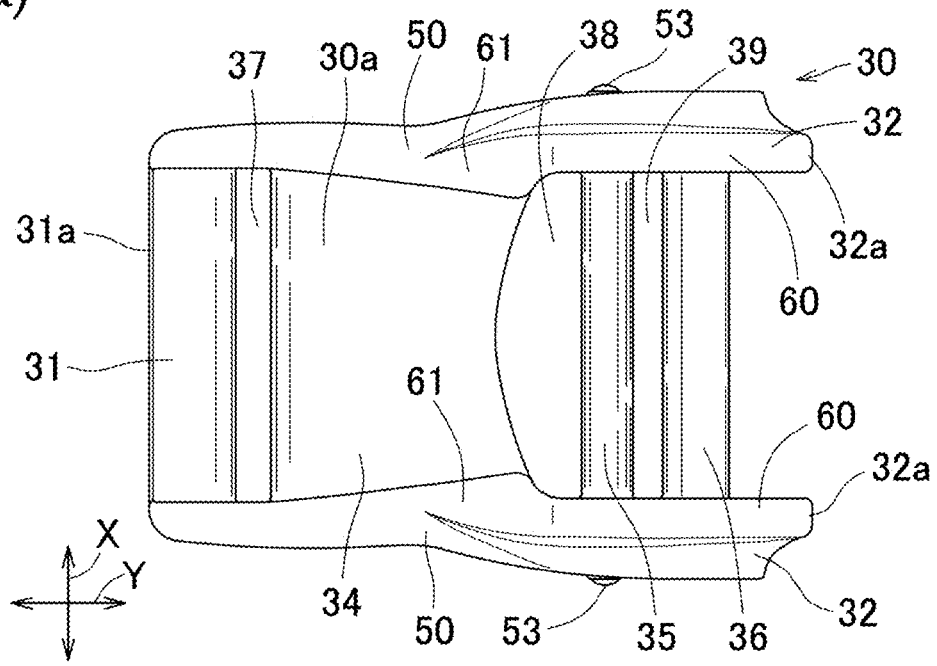
FIG. 4(*a*) is a plan view of a buckle.
Figure 4B:
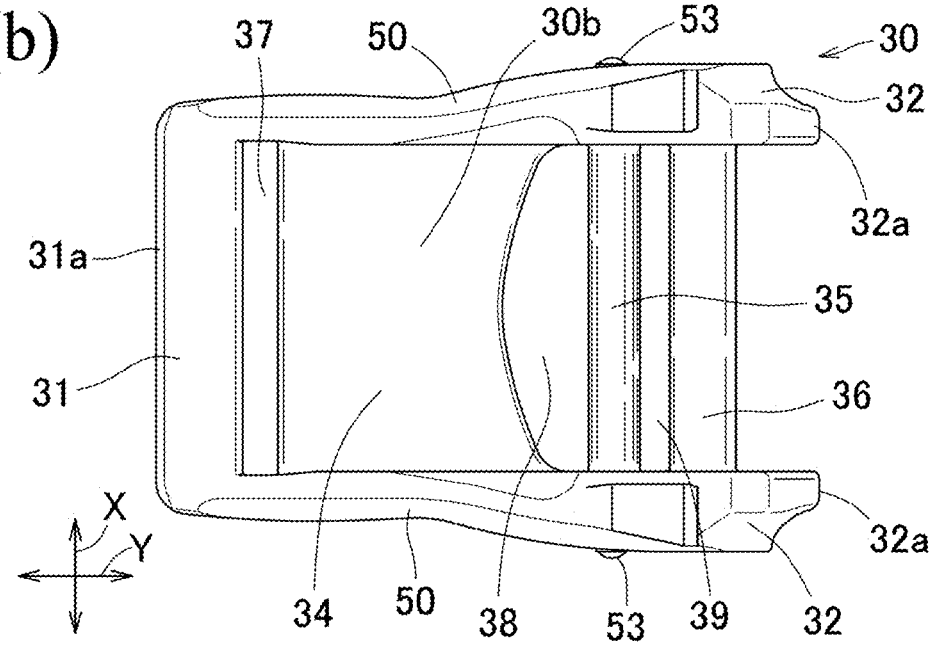

Referring to FIGS. 4(*a*) and 4(*b*), the buckle 30 has a width direction X, a length direction Y, and a thickness direction Z, and includes a front face 30*a* disposed outside in a use state and a rear face 30*b* disposed on the opposite side of the front face 30*a* to face the air cylinder 3, a distal end edge 31*a* and base end edges 32*a* opposed to each other respectively in the length direction Y, both side edges extending in the length direction Y between the end edges 31*a* and 32*a*, a distal end portion 31 that is relatively thin, and a pair of base end portions 32 that are relatively thick.

The buckle 30 further includes a pair of side walls 50 extending in the length direction between the distal end edge 31*a* and the base end edges 32*a*, the distal end portion 31 extending in the width direction X between the side walls 50, a flat panel wall 34 extending in the width direction X on a base end edge 32*a* side of the distal end portion 31, and first and second wound portions 35 and 36 spaced from the flat panel wall 34 and extending in the width direction X. A first insertion hole 37 is disposed between the distal end portion 31 and the flat panel wall 34, a second insertion hole 38 is disposed between the flat panel wall 34 and the first wound portion 35, and a third insertion hole 39 is disposed between the first wound portion 35 and the second wound portion 36.

Figure 5A:
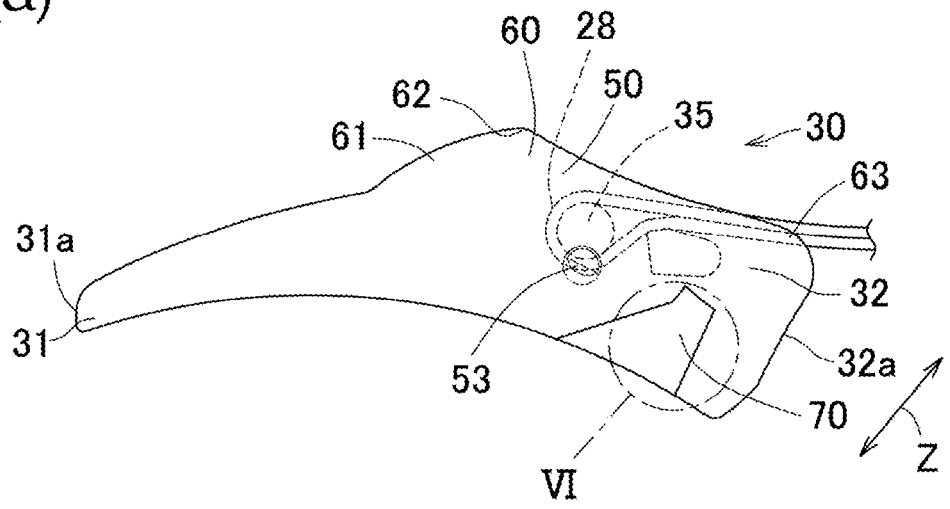
FIG. 5(*a*) is a side view of the buckle.
Figure 5B:
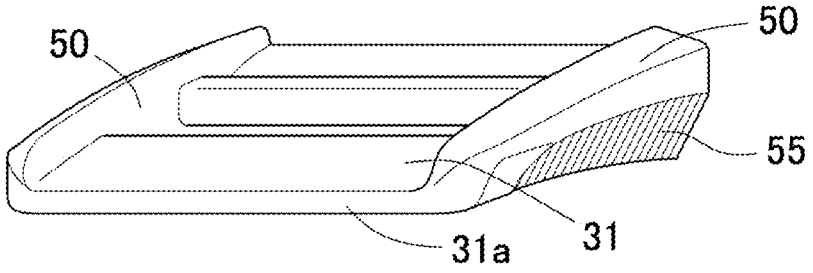

Referring to FIGS. 2 and 5(*a*), the belt 20 is attached to the buckle 30 by inserting the second end portion 22 into the second insertion hole 38 from a front face side of the buckle 30 and then into the third insertion hole 39 from a rear face side while winding the second end portion 22 around the first wound portion 35, and pulling it out from the buckle 30. In a fastening state of the fastening device 10, the belt 20 is tightened, and tensile force to pull a wound portion 28 of the belt 20 wound around the first wound portion 35 continuously acts on the wound portion 28 in a direction of an arrow F1 (see FIG. 7) along a circumferential direction L of the air cylinder 3.

Referring to FIGS. 5(*a*) and 5(*b*), both the side walls 50 protrude further than the distal end portion 31 and the flat panel wall 34 in the thickness direction Z, and include outer ribs 60 further protruding outward on the front face 30*a* side from the base end edge 32*a* side of the flat panel wall 34 to the base end edges 32*a*. The outer ribs 60 have slightly curved concave shapes, and include wide portions 61 on the base end edge 32*a* side of the flat panel wall 34, first bent portions (bent portions) 62, and second bent portions 63. The outer ribs 60 also slightly extend further from the base end edges 32*a* toward the rear face 30*b*.

The wide portions 61 are each in an approximate arrow feather shape inclined to the rear face 30*b* side, and wider than other parts of the outer ribs 60. In addition, a pair of stoppers 53 each in a projection shape are disposed on the side walls 50 at intersecting portions with the first wound portion 35.

As for a thickness dimension of each of the side walls 50, a portion on the base end edge 32*a* side is thicker than a portion on the distal end edge 31*a* side, and a portion of a side face of the side wall 50 on the rear face 30*b* side inclines inward in the width direction X. With such inclined portions 55 of the side walls 50 of the buckle 30, the user can insert fingers into the inclined portions 55 to stably hold the entire buckle 30 when fastening or releasing the fastening device 10. In FIG. 5(*b*), the inclined portion 55 is shown by oblique lines for convenience of description.

Figure 6:
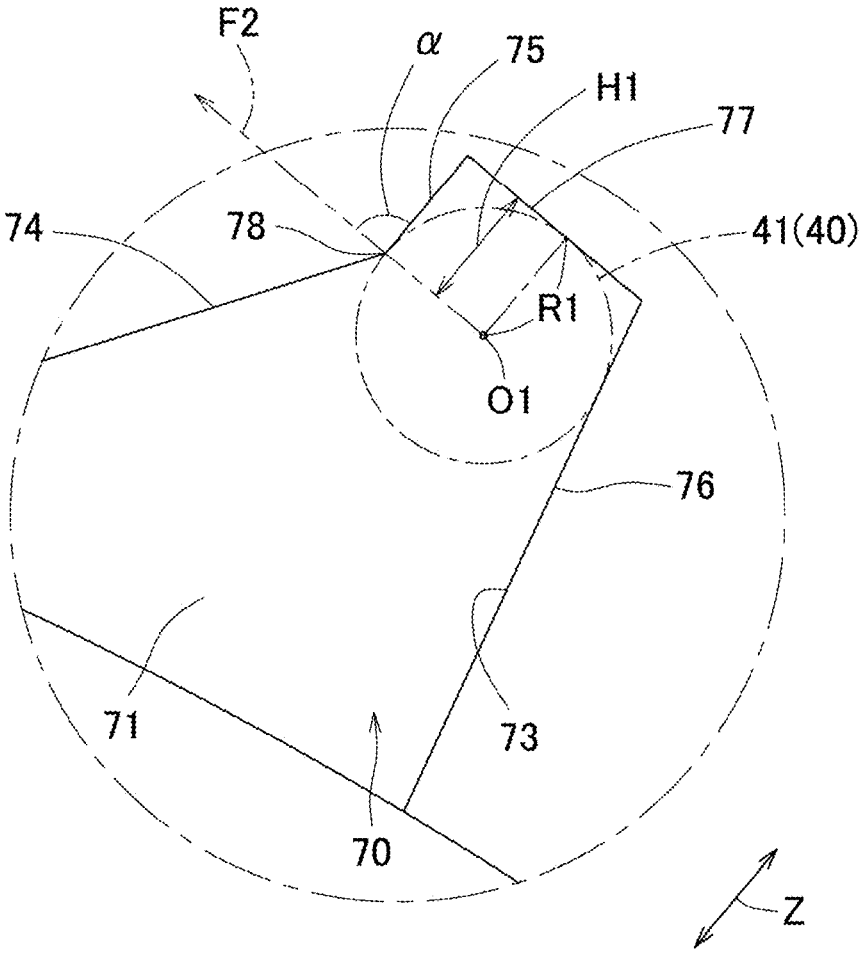
FIG. 6 is an enlarged view of a locking groove circled by the line VI of FIG. 5(*a*).

Referring to FIG. 6, locking grooves 70 are formed on both sides of the pair of base end portions 32, and the locking portions 41 of the coupling ring 40 are releasably locked in the locking grooves 70. Each of the locking grooves 70 is a bottomed groove extending from the rear face 30*b* side to the front face 30*a* side in the thickness direction Z, and includes an opening 71 and an inner circumferential face 73 in a shape of a combination of a plurality of linear lines and a plurality of curved lines.

The inner circumferential face 73 of the locking groove 70 includes an inclined wall face 74 on the distal end side, a first wall face 75 extending from the inclined wall face 74 toward the front face 30*a* side, a second wall face 76 on the base end edge 32*a* side, and a bottom wall 77 connecting the first wall face 75 and the second wall face 76. A corner 78 is located between the inclined wall face 74 and the first wall face 75.

Figure 7:
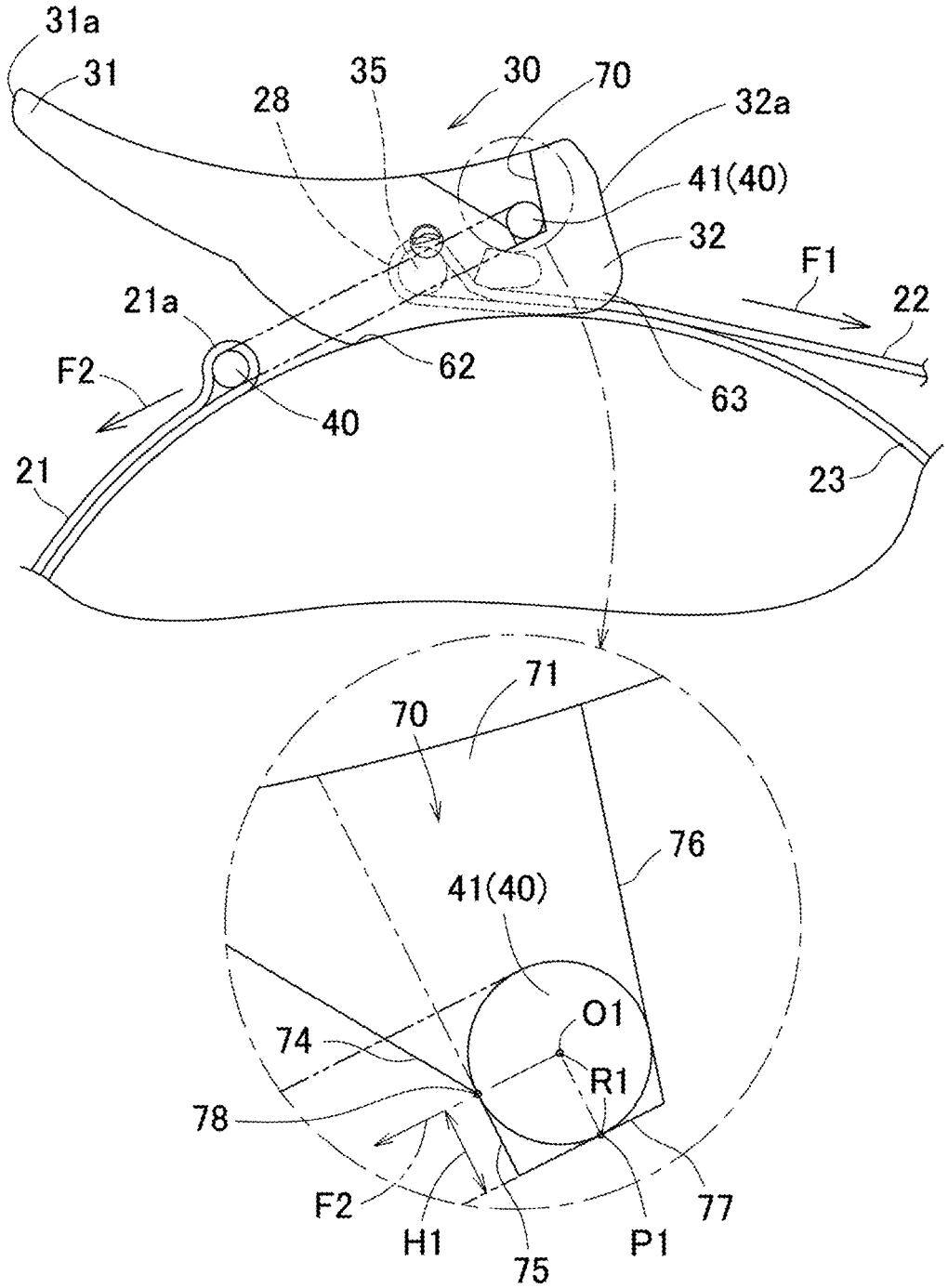
FIG. 7 is a diagram showing the fastening device before fastening.

Referring to FIG. 7, in order to fasten the air cylinder 3 by the fastening device 10, the user first holds the coupling ring 40 with one hand and the buckle 30 with the other hand, and pulls the coupling ring 40 and the buckle 30 closer to couple them. At this time, the front face 30*a* of the buckle 30 faces the air cylinder 3, and the first bent portions 62 on the front face 30*a* side are in contact with the air cylinder 3. In such a state, the locking portions 41 of the coupling ring 40 are inserted into the openings 71 of the locking grooves 70 in the side walls 50.

With the inclined wall faces 74 disposed on the distal end edge 31*a* side of the locking grooves 70, the locking portions 41 of the coupling ring 40 can be guided into the locking grooves 70 smoothly. In addition, in such a state, since the stoppers 53 of the buckle 30 are in contact with the coupling ring 40, displacement of the coupling ring 40 during coupling operation can be suppressed.

As shown in an enlarged view in FIG. 7, the coupling ring 40 passes through the inclined wall face 74 and stays in contact with the inner circumferential face 73 of the locking groove 70, and tensile force continuously acts on the coupling ring 40 in a direction of an arrow F2 along a circumferential direction of the air cylinder 3.

Figure 8:
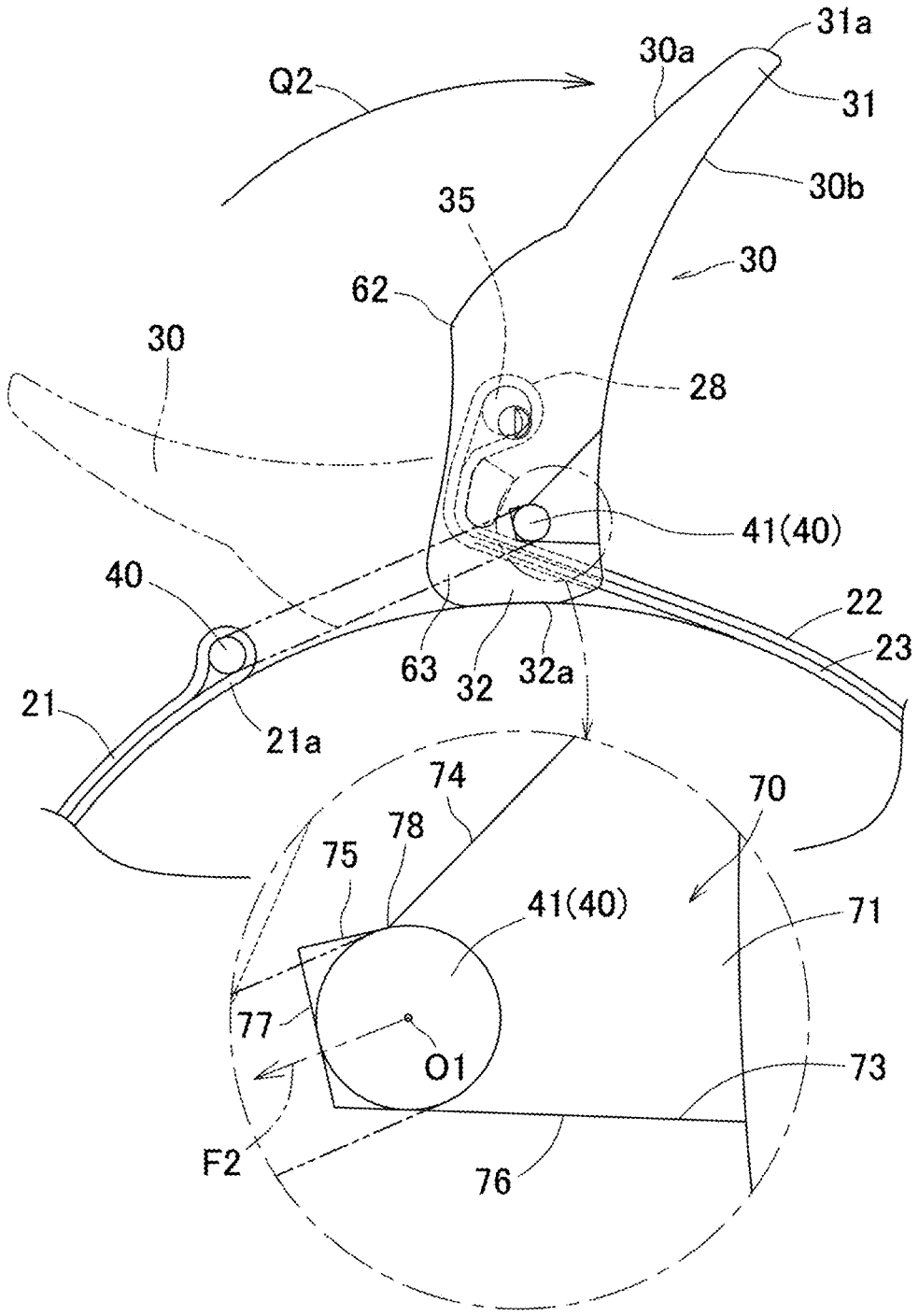
FIG. 8 is a diagram showing the fastening device with the buckle raised for length adjustment of the belt.

Referring to FIG. 8, when the user holds the distal end portion 31 and rotates the buckle 30 in a direction of an arrow Q2 from a state shown in FIG. 7, the outer ribs 60 on the front face 30*a* side of the buckle 30 are brought into contact with the air cylinder 3. In such a state, the coupling ring 40 is in contact with the corners 78 of the inner circumferential faces 73. Since the outer ribs 60 of the buckle 30 have curved concave shapes curved toward the front face side, the outer ribs 60 are brought into contact with an outer circumferential face of the air cylinder 3 to fit the outer circumferential face, so that a contact state can be stably maintained.

Furthermore, when the user supports the raised buckle 30 with one hand, and holds the second end portion 22 of the belt 20 with the other hand and pushes the second end portion 22 toward the buckle 30, tension on the wound portion 28 of the belt 20 wound around the first wound portion 35 is released to put the wound portion 28 in a loosened state.

When the user adjusts the length of the belt 20 in the loosened state to fit the outer circumferential dimension of the air cylinder 3, and pulls the second end portion 22 in a direction separating from the buckle 30 to sufficiently tighten the belt 20 to an extent unable to pull the second end portion 22 any further, the tensile force in the direction of the arrow F1 acts on the wound portion 28 of the belt 20 wound around the first wound portion 35 of the buckle 30. On the other hand, opposite tensile force in the direction of the arrow F2 acts on the coupling ring 40. As a result, the belt 20 is tightened by the buckle 30 to temporarily fasten the air cylinder 3.

Thus, since the length of the belt 20 can be adjusted after the coupling ring 40 and the buckle 30 are coupled, the length of the belt 20 can be easily adjusted to a suitable length even when another type of air cylinder 3 is used and an outer diameter of the air cylinder 3 changes. In addition, since a state of the belt 20 pulled by the user until sufficiently tightened is an optimal length of the belt 20, adjustment itself is easy.

Figure 9:
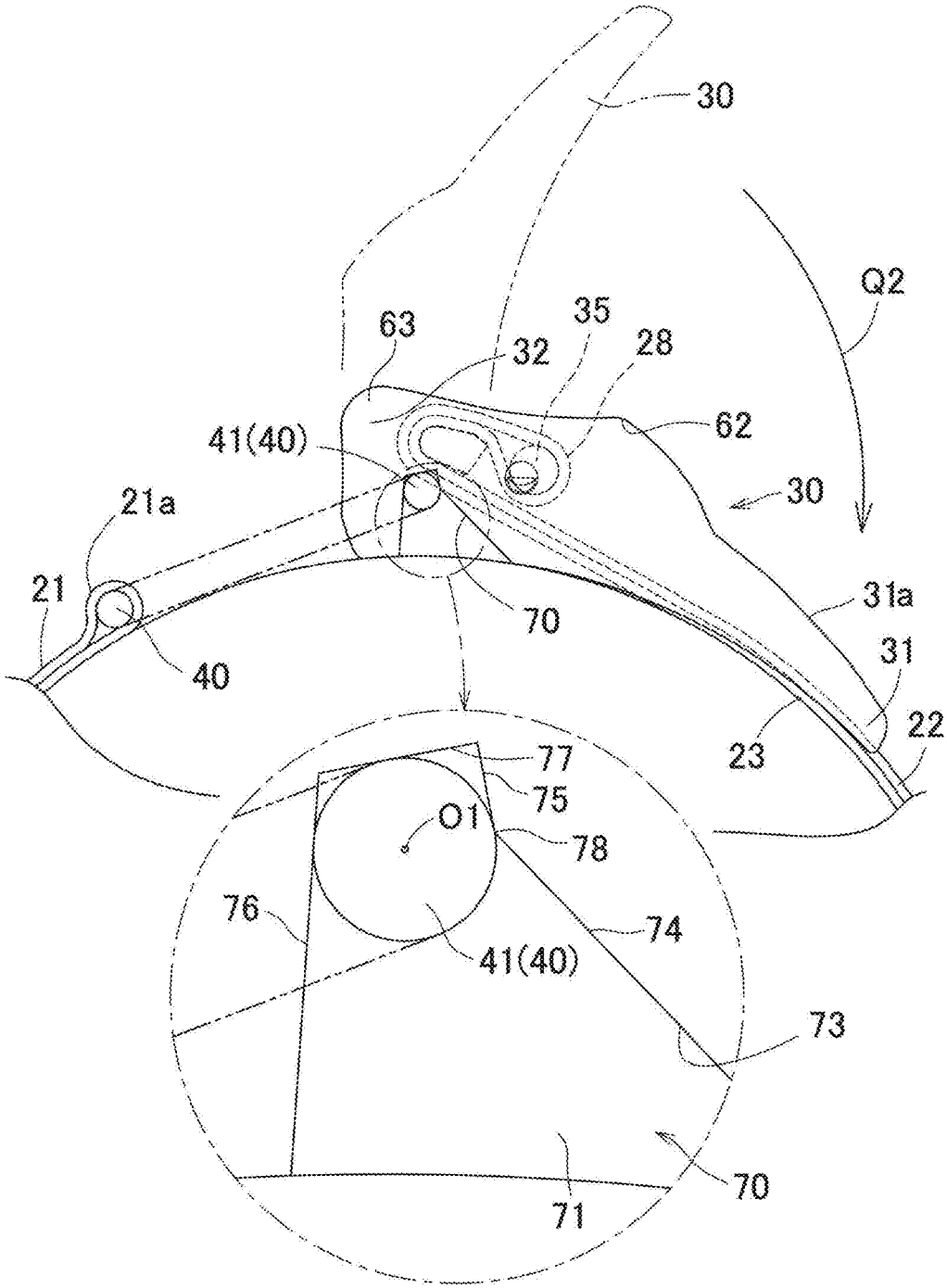
FIG. 9 is a diagram showing the fastening device in a fastening state.

Referring to FIG. 9, when the user holds the distal end portion 31 and further rotates the buckle 30 in the direction of the arrow Q2 from a state shown in FIG. 8, the base end portions 32 are brought into contact with an outer face of the air cylinder 3 to put the buckle 30 in a raised state on the air cylinder 3. Since the base end edges 32*a* of the buckle 30 have curved concave shapes, the base end edges 32*a* are brought into contact with the outer circumferential face of the cylindrical air cylinder 3 to fit the outer circumferential surface, which facilitates maintenance of the raised state.

When the buckle 30 is put in the raised state in such a manner, the belt 20, the length of which has been adjusted in the state shown in FIG. 8, is locked in a temporary fastened state. Although not shown, the second end portion 22 is inserted through the first insertion hole 37 from the rear face 30*b* side of the buckle 30, so that the buckle 30 can be pressed harder against the air cylinder 3 to enable firmer locking.

Referring to FIG. 9, when the user holds the distal end portion 31 and further rotates the buckle 30 in the direction of the arrow Q2 from the raised state shown in FIG. 8, the buckle 30 is laid down with the rear face 30*b* facing the air cylinder 3 to completely lock the belt 20 in the tightened state. Furthermore, the hook portion 25 in the second end portion 22 of the belt 20 inserted through the first insertion hole 37 is fastened to the target portion 26 in the intermediate portion 23, so that the second end portion 22 can be prevented from flapping during diving.

Figure 10:
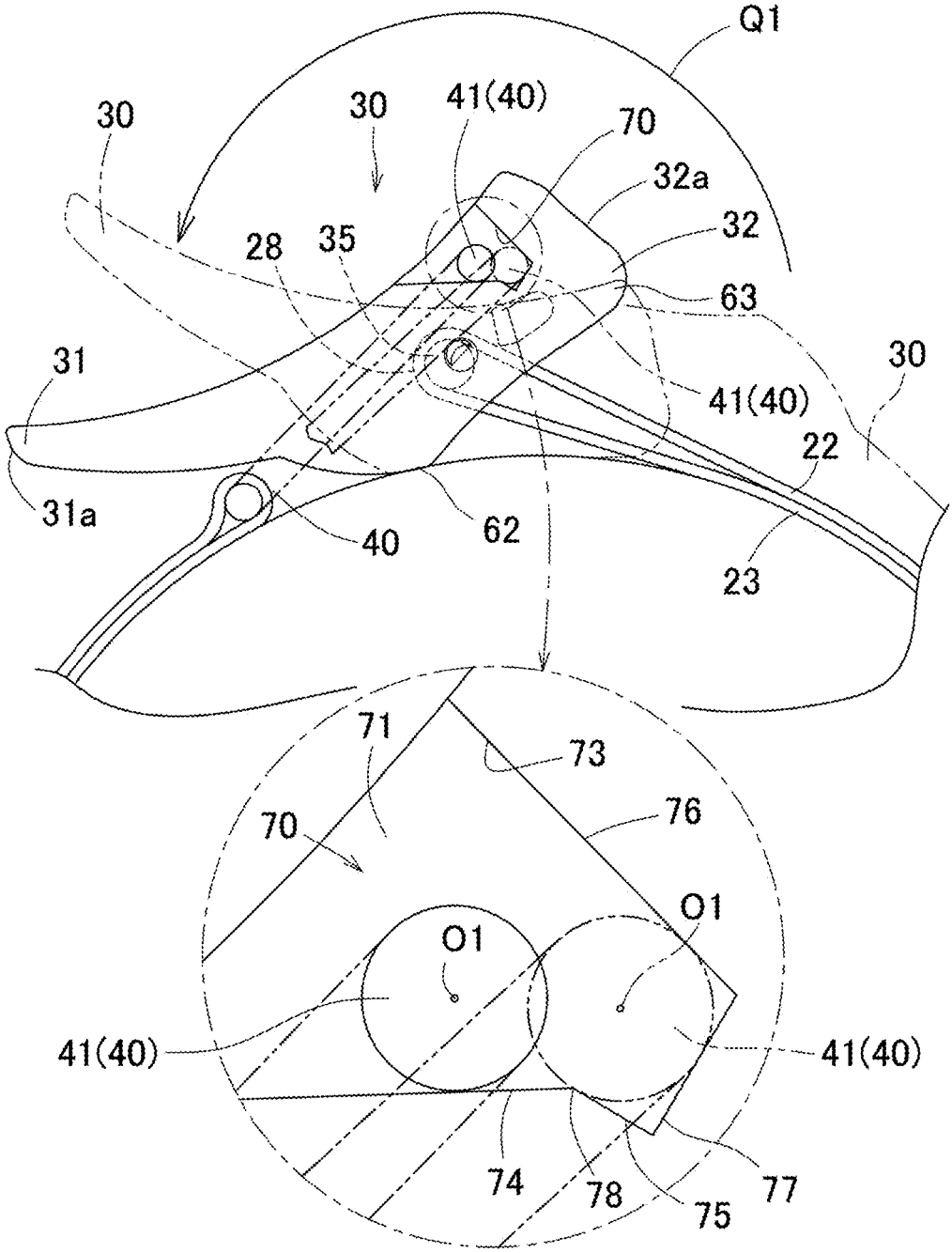
FIG. 10 is a diagram showing the fastening device when coupling is released.

Referring to FIG. 10, in order to release the fastening of the fastening device 10, the user holds the distal end portion 31 with one hand and rotates it in the direction of the arrow Q1, and, as shown in the figure, inverts the buckle 30 such that the outer ribs 60 on the front face 30*a* side of the buckle 30 are brought into contact with the air cylinder 3. With further force applied, the buckle 30 is further rotated with the first bent portions 62 of the outer ribs 60 as fulcrums. At this time, the buckle 30 is largely inclined, so that the locking portions 41 of the coupling ring 40 urged in the direction of the arrow F2 go over the corners 78 and move toward the openings 71.

The locking portions 41 move toward the openings 71 along the inclined wall faces 74 and leave the locking grooves 70 through the openings 71, which releases coupling by the buckle 30. Thus, since the coupling is released by inclining the buckle 30 to the distal end side with the corners 78 as fulcrums, the user can perform the releasing operation by a single operation with one hand.

In order to perform the releasing operation of the coupling by the single operation in such a manner, following requirements need to be satisfied: i) the buckle 30 includes the locking grooves 70 in which the locking portions 41 of the coupling ring 40 are locked; ii) the locking grooves 70 gradually widen toward the rear face 30*b* side, and include the openings 71; and iii) the bent portions 62 are disposed on the front face 30*a* side of the buckle 30.

Furthermore, in the inner circumferential face 73 of each of the locking grooves 70, since the inclined wall face 74 is not linear, but inclined to gradually extend toward the distal end edge 31*a* side from the corner 78 to the rear face side, the opening 71 can be formed wider so as to allow the locking portion 41 to enter the locking groove 70 easily, and the inclined surface 74 can function as a guide for releasing the locking portion 41 from the distal end side of the opening 71 when the coupling is released.

Referring to FIG. 6, an angle $\alpha$ between the first wall face 75 and a virtual line F2 of the tensile force extending from a center point O1 of the locking portion 41 of the coupling ring 40 is preferably 90 degrees or less. If the angle $\alpha$ is 90 degrees or more, locking by the locking portion 41 may be released unintentionally during coupling operation and/or releasing operation of the coupling to release the locking portion 41 from the opening 71.

In the temporary fastened state of the belt with the buckle 30 raised, the locking portion 41 of the coupling ring 40 is preferably in contact with the first wall face 75 and the bottom wall 77 of the inner circumferential face 73 of the locking groove 70. In such a case, the movement of the locking portion 41 toward the distal end side is regulated, and thus the release of the locking by the coupling ring 40 can be prevented in the temporary fastened state.

Furthermore, a height dimension H1 of the first wall face 75, that is, a spacing dimension in the thickness direction Z from the bottom wall 77 to the corner 78 is larger than the radius R1 of the cross-sectional shape of the locking portion 41 of the coupling ring 40.

For example, if the height dimension H1 is smaller than the radius R1 of the locking portion 41, the locking portion 41 may go over the corner 78 and move toward the distal end edge 31*a* side when the tensile force in the direction of the arrow F2 acts in the temporary fastened state. In the present invention, since the height dimension H1 is larger than the radius R1, the locking portion 41 does not go over the corner 78 or move to the distal end edge 31*a* side even if the tensile force in the direction of the arrow F2 acts in the temporary fastened state.

Furthermore, as have been described, since the first bent portions 62 function as the fulcrums of the rotation of the buckle 30 when the coupling of the buckle 30 is released, the first bent portions 62 are preferably disposed near a center portion of a dimension in a longitudinal direction Y of the buckle 30. With the first bent portions 62 disposed near the center portion, a balance is maintained in a state where the rear face 30*b* of the buckle faces the air cylinder, so that unintentional inclination of the buckle 30 to the distal end side can be suppressed.

Thus, since the user can release the coupling between the coupling ring 40 and the buckle 30 by a single operation with one hand, without using both hands, superior operability is exerted compared with a case requiring both hands for the releasing operation of the coupling. Furthermore, since a principle of leverage is used with the first bent portions 62 of the outer ribs 60 as the fulcrums, particularly large force is not required. Thus, even women can perform the releasing operation of the coupling by a single operation with respect to the fastening device 10 of the buoyancy compensator jacket, the weight of which has been increased due to the water contained therein after diving.

In the fastening device 10 according to the present invention, the buckle 30 can be completely separated from the belt 20, and thus the buckle 30 can be independently cleaned or replaced.

Referring back to FIG. 5(*a*), the first bent portions 62 have arc shapes curving sharper than the second bent portions 63 in the outer ribs 60. With such shapes of the outer ribs 60, when the fastening of the fastening device 10 is released, the buckle 30 can be largely inclined instantaneously due to the first bent portions 62 to release the coupling ring 40 from the locking grooves 70. On the other hand, when the buckle 30 in the raised state is laid down, the buckle 30 is slowly rotated due to the second bent portions 63 that are relatively gently curved to suppress the release of the coupling of the coupling ring 40.

Second Embodiment

FIGS. 11 to 15 are similar to FIGS. 6 to 10, and show the fastening device 10 for the air cylinder according to a second embodiment. Differences from the fastening device 10 for the air cylinder according to the first embodiment are mainly described below.

Figure 11:
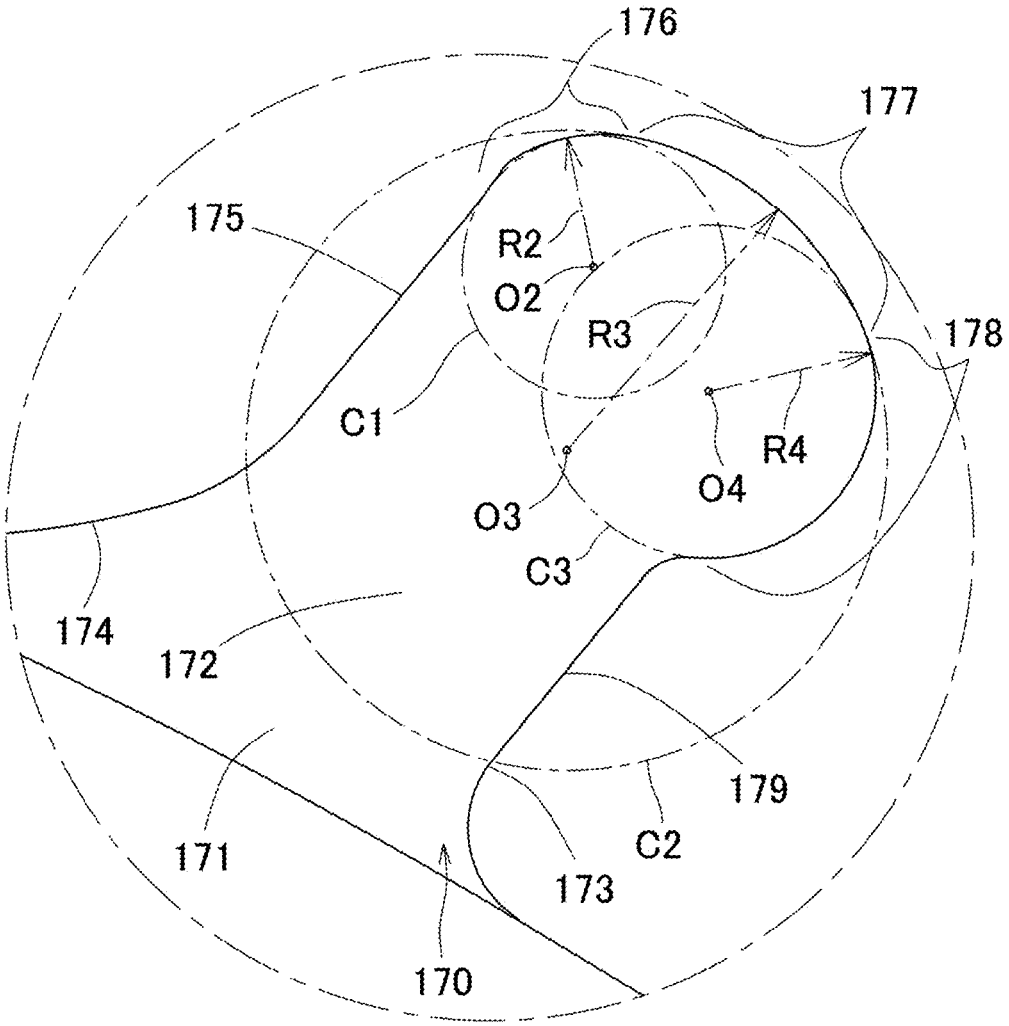
FIG. 11 is an enlarged view of the locking groove according to a second embodiment.

Referring to FIG. 11, an inner circumferential face 173 of a locking groove 170 according to the present embodiment includes an inclined wall face 174, a first wall face 175, a first curved wall face 176, a second curved wall face 177, a third curved wall face 178, and a second wall face 179, which are continuously disposed from the distal end edge 31*a* side to the base end edge 32*a* side.

The first to third curved wall faces 176, 177, and 178 have arc shapes having different curvatures, and, in particular, are arcs of virtual circles C1 to C3 with center points O2, O3, and O4 and radii R2, R3, and R4, respectively.

A correlation of dimensions of the radii R2 to R4 of the virtual circles C1 to C3 is the radius R3 of the virtual circle C2 of the second curved wall face 177>the radius R4 of the virtual circle C3 of the third curved wall face 178>the radius R2 of the virtual circle C1 of the first curved wall face 176.

Figure 12:
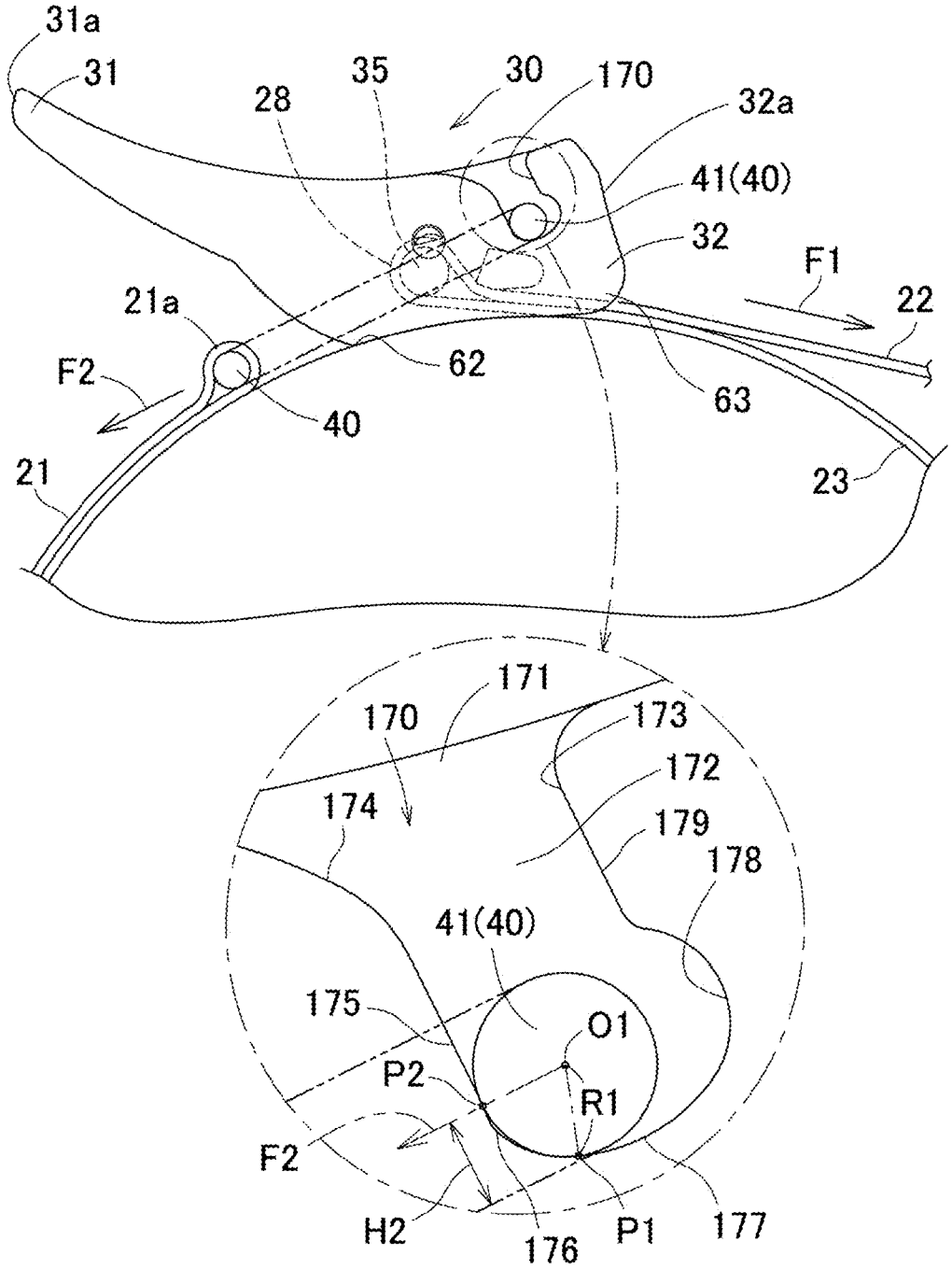
FIG. 12 is a diagram showing the fastening device before fastening.

Referring to FIG. 12, in the fastening device 10 before fastening, the coupling ring 40 passes through the inclined wall face 174 and stays in contact with the inner circumferential face 173 of the locking groove 170, and the tensile force constantly acts on the coupling ring 40 in the direction of the arrow F2 along the circumferential direction of the air cylinder 3. Furthermore, compared with a distance between a contact point P1 of the locking portion 41 of the coupling ring 40 with the inner circumferential face 173 and the center point O1, that is, the radius R1 of the cross-sectional shape of the locking portion 41, a height dimension H2 of a contact point P2 on the distal end edge 31*a* side, that is, a spacing dimension between the contact point P1 and the contact point P2 is smaller.

For example, if the height dimension H2 is larger than the radius R1 of the locking portion 41, the contact point P2 is located on the rear face 30*b* side of the center point O1 as a center of gravity of the locking portion 41, which may let the locking portion 41 move to the distal end edge 31*a* side when the tensile force in the direction of the arrow F2 acts on the locking portion 41. In the present invention, since the radius R1 is larger than the height dimension H2, and thus the contact point P2 is located on the front face 30*a* side of the center point O1 as the center of gravity, the locking portion 41 does not move to the distal end edge 31*a* side even if the tensile force in the direction of the arrow F2 acts on the locking portion 41.

Furthermore, part of the inner circumferential face 173 that the locking portion 41 is in contact with is formed of a combination of the first wall face 175 and the first curved wall face 176 having different shapes, and thus the locking portion 41 comes in contact with the inner circumferential face 173 at a point rather than a surface. This can prevent the coupling ring 40 from moving to the distal end edge 31*a* side when the coupling ring 40 and the buckle 30 are coupled, and also smoothly move the coupling ring 40 from the first curved wall face 176 to the second curved wall face 177 when the buckle 30 is raised.

Figure 13:
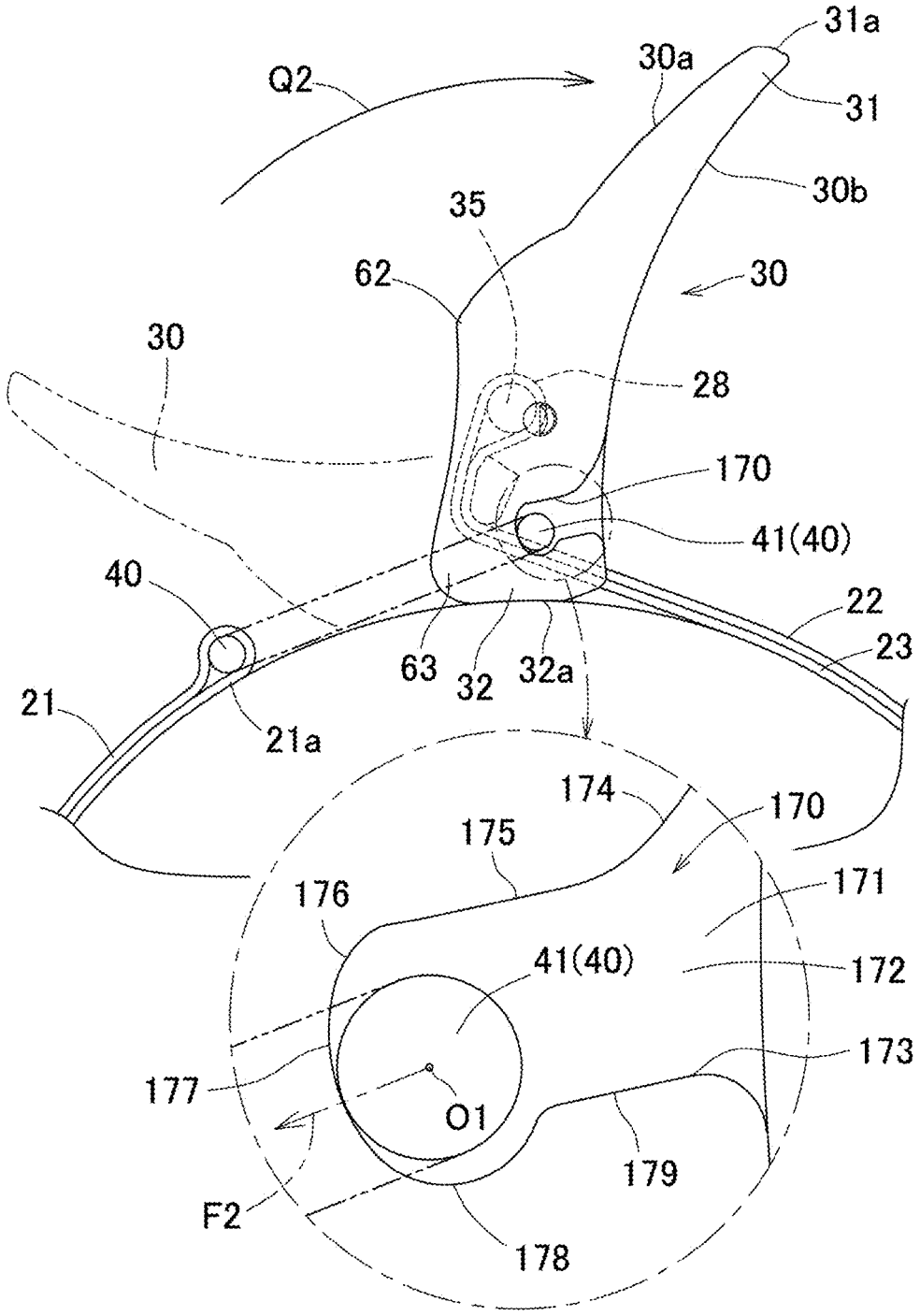
FIG. 13 is a diagram showing the fastening device with the buckle raised for the length adjustment of the belt.

Referring to FIG. 13, in the raised state of the buckle 30, the locking portion 41 of the coupling ring 40 is in contact with the second curved wall face 177 that is continuous from the first curved wall face 176 and curves more gently than the first curved wall face 176. If the second curved wall face 177 is linear, when the buckle 30 is rotated to be raised, the coupling ring 40 cannot move while staying in contact with the inner circumferential face 173 of the locking groove 170 due to the change in the shapes from the first curved wall face 176, and instantaneously separates from the inner circumferential face 173 to drop and hit the second curved wall face 177, which may cause a loud impact noise.

In the present embodiment, since the second curved wall face 177 is curved, and the coupling ring 40 moves along the inner circumferential face 173 from the first curved wall face 176 to the second curved wall face 177 when the buckle 30 is raised, no impact noise is caused. Furthermore, since the second curved wall face 177 curves more gently than the first curved wall face 176, the coupling ring 40 does not separate from the inner circumferential face 173 even when the buckle 30 is rotated quickly.

Figure 14:
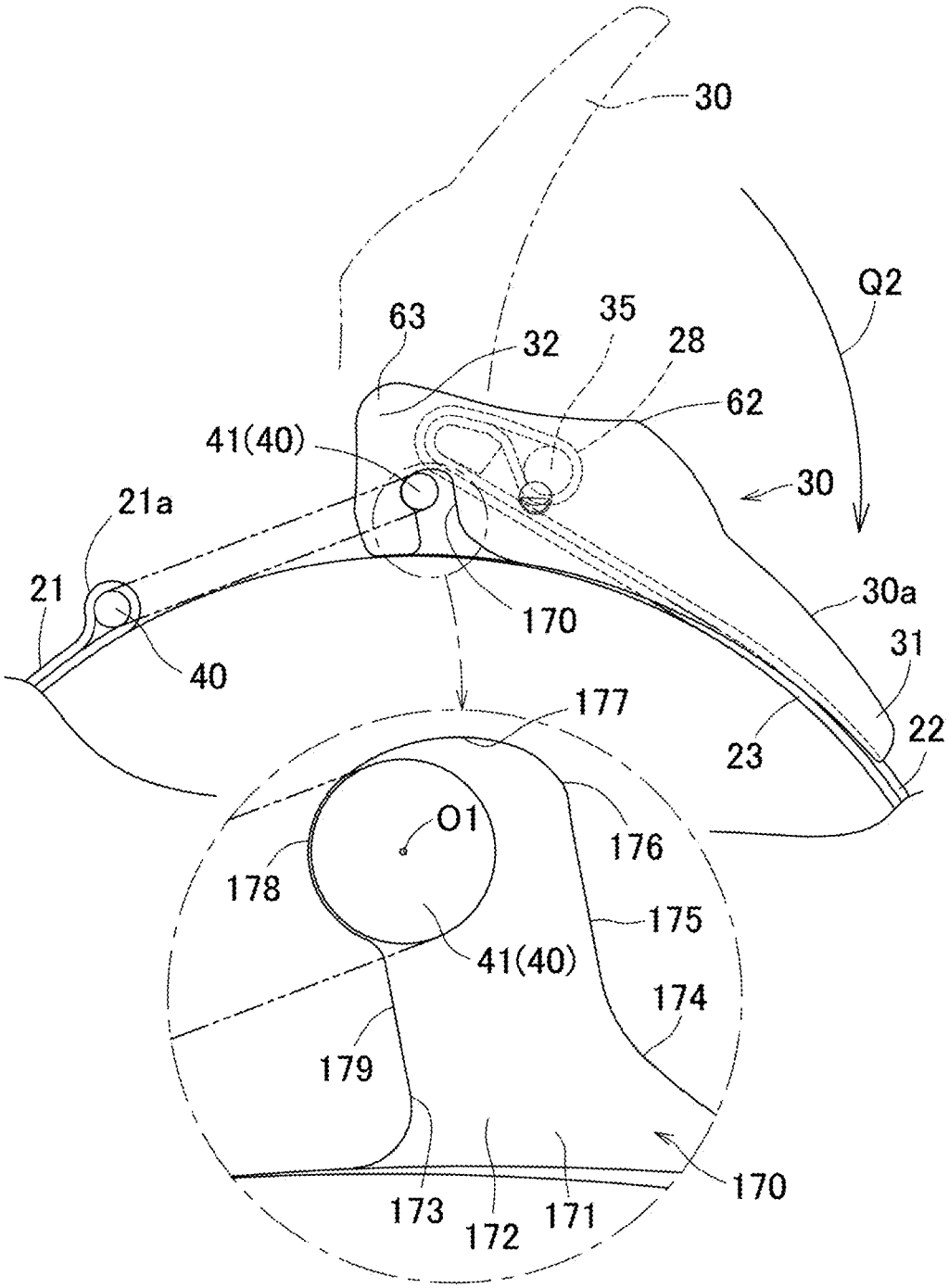
FIG. 14 is a diagram showing the fastening device in the fastening state.

Referring to FIG. 14, in the locked state of the belt 20, the locking portion 41 of the coupling ring 40 is in contact with the third curved wall face 178 of the inner circumferential face 173 at a plurality of contact points. If the radius R1 of the cross section of the locking portion 41 is larger than the radius R4 of the virtual circle C3 forming the third curved wall face 178, the locking portion 41 cannot make contact with the third curved wall face 178 at the plurality of contact points.

In the present embodiment, the radius R4 of the virtual circle C3 of the third curved wall face 178 is almost equal to or slightly larger than the radius R1 of the cross section of the locking portion 41, and thus the locking portion 41 can make contact with the third curved wall face 178 at the plurality of contact points so as to stably maintain the locked state of the belt 20.

Furthermore, the radius R4 of the virtual circle C3 of the third curved wall face 178 is smaller than the radius R3 of the virtual circle C2 of the second curved wall face 177, and thus the third curved wall face 178 curves sharper than the second curved wall face 177, so that a contact area between the third curved wall face 178 and the locking portion 41 is designed to be larger than a contact area between the second curved wall face 177 and the locking portion 41. However, depending on a level of fastening strength required for the fastening device 10 or the like, the contact point between the third curved wall face 178 and the locking portion 41 may be at least one.

Figure 15:
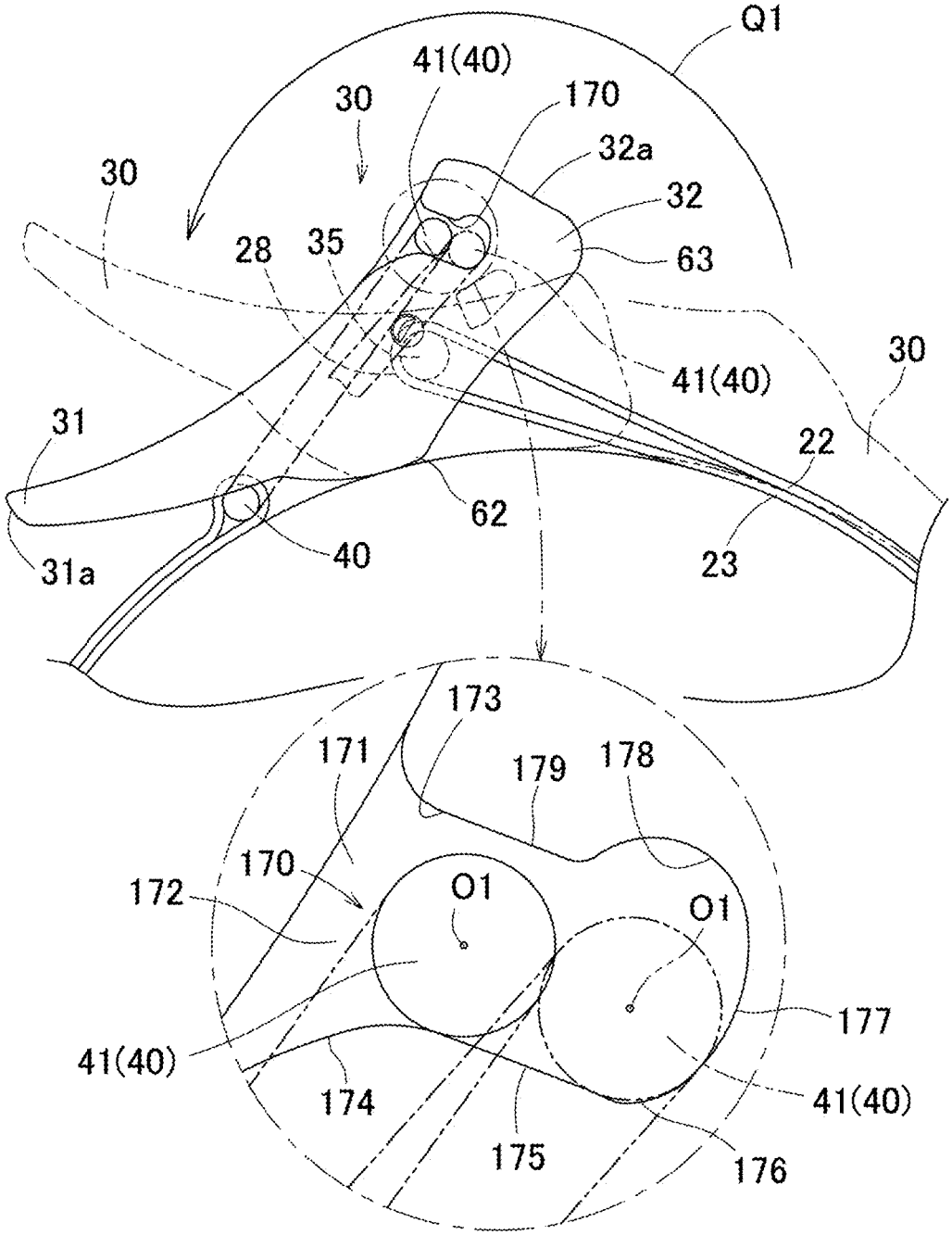
FIG. 15 is a diagram showing the fastening device when coupling is released.

Referring to FIG. 15, in order to release the fastening of the fastening device 10, the buckle 30 is largely inclined, which causes the locking portion 41 of the coupling ring 40 urged in the direction of the arrow F2 to move toward the opening 171 along the inner circumferential face of the locking groove 170. In particular, the locking portion 41 moves from the first curved wall face 176 to the first wall face 175, further toward the opening 171 along the inclined wall face 174, and passes the opening 171 to leave the locking groove 170. As a result, the coupling between the coupling ring 40 and the buckle 30 is released, and the fastening of the fastening device 10 is released.

Figure 16:
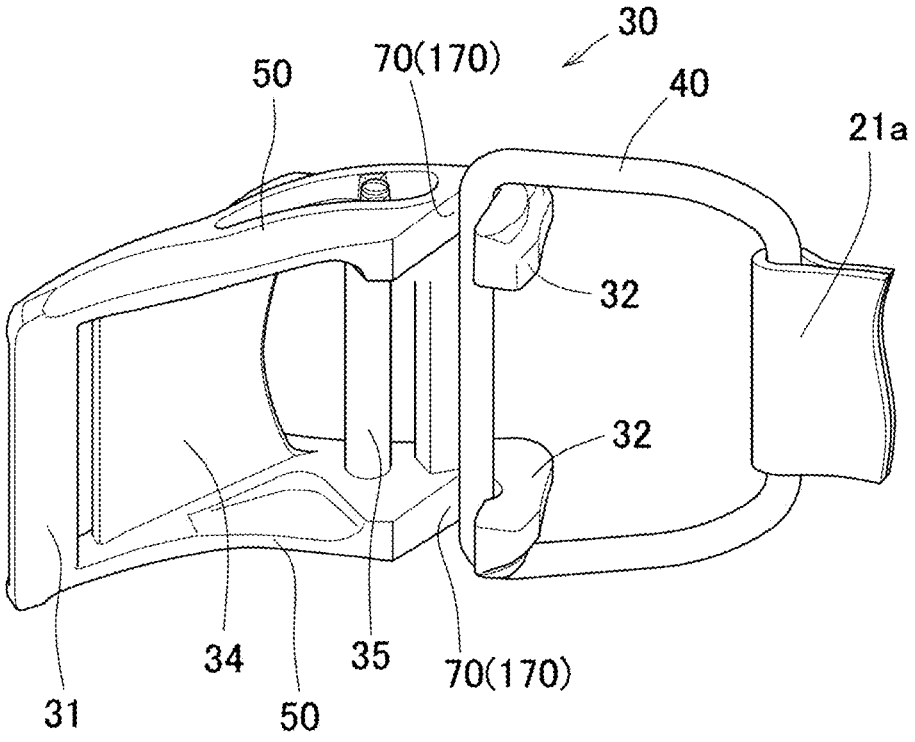
FIG. 16 is a perspective view of the fastening device according to another mode.

FIG. 16 is a perspective view of the fastening device 10 according to another mode of the first or second embodiment. In this mode, the coupling ring 40 is formed of a so-called O-ring having a continuous circular shape instead of the C-ring. In such a case, although the bottom walls 77 of the locking grooves 70 are omitted, and part of the coupling ring 40 traverses the width direction X of the buckle 30, the same technical effects are exerted.

Various known materials generally used in this kind of field can be used without limitation for constituent materials included in the fastening device 10, unless otherwise described in this specification. Terms such as "first" or "second" used in this specification are used simply to distinguish similar elements, positions, or the like.

What is claimed is:

1. A fastening device for an air cylinder, the fastening device comprising:

a belt including a first end portion and a second end portion;

a coupling ring attached to the first end portion of the belt; and a buckle to which the second end portion of the belt is attached, the buckle including a front face and a rear face, a distal end edge, base end edges, base end portions, and locking grooves that are disposed in the base end portions and in which locking portions of the coupling ring are releasably locked, the locking grooves including openings that gradually widen toward a rear face side, the front face of the buckle including bent portions that are brought into contact with an outer circumferential face of the air cylinder when coupling between the belt and the coupling ring is released, wherein an inner circumferential face of the locking groove includes an inclined wall face disposed on a distal end side of the buckle, a first wall face extending from the inclined wall face toward a front face side, and a second wall face disposed on a base end side and a bottom wall connecting the first wall face and the second wall face, a corner is disposed between the inclined wall face and the first wall face, and a spacing dimension between the bottom wall and the corner is larger than a radius of the locking portion.

2. The fastening device according to claim 1, wherein an angle $\alpha$ between the first wall face and a virtual line of tensile force extending from a center point of each of the locking portions of the coupling ring is 90 degrees or less.

3. The fastening device according to claim 1, wherein the bent portions are disposed near a center portion of a longitudinal dimension of the buckle.

* * * * *